US008870110B2

(12) United States Patent
Fiorucci et al.

(10) Patent No.: US 8,870,110 B2
(45) Date of Patent: Oct. 28, 2014

(54) MODULAR TRIPPER FOR ROLLING MILL LAYING HEAD

(75) Inventors: Keith Fiorucci, Sturbridge, MA (US); Christopher Lashua, Gardner, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 160 days.

(21) Appl. No.: 13/559,983

(22) Filed: Jul. 27, 2012

(65) Prior Publication Data

US 2013/0075229 A1 Mar. 28, 2013

Related U.S. Application Data

(60) Provisional application No. 61/539,076, filed on Sep. 26, 2011.

(51) Int. Cl.
*B21C 47/24* (2006.01)
*B21C 47/14* (2006.01)
*B21C 47/26* (2006.01)

(52) U.S. Cl.
CPC ..... *B21C 47/143* (2013.01); *B21C 47/262* (2013.01)
USPC ..... 242/361.5; 242/361.3; 242/362.2

(58) Field of Classification Search
USPC ..... 242/361.3, 361.5, 362.2, 362.3, 363; 193/2 R, 33, 2 D; 182/48; 198/383, 198/457.05, 525, 633
See application file for complete search history.

(56) References Cited

U.S. PATENT DOCUMENTS

| | | | | |
|---|---|---|---|---|
| 3,405,885 | A | | 10/1968 | Beerens |
| 3,460,777 | A | * | 8/1969 | Schroder ..... 242/361.3 |
| 3,469,798 | A | * | 9/1969 | Schroeder ..... 242/361.3 |
| 3,563,488 | A | | 2/1971 | Bollig |
| 4,193,489 | A | * | 3/1980 | Siniscal ..... 198/406 |
| 4,239,099 | A | * | 12/1980 | Williams et al. ..... 193/32 |
| 4,274,527 | A | * | 6/1981 | Baker ..... 193/32 |
| 4,454,949 | A | * | 6/1984 | Flum ..... 211/59.2 |
| 4,923,090 | A | * | 5/1990 | Rockola et al. ..... 221/312 R |
| 5,634,607 | A | * | 6/1997 | Poloni ..... 242/363 |
| 5,775,617 | A | * | 7/1998 | Poloni ..... 242/363 |
| 5,992,616 | A | * | 11/1999 | Kliesow et al. ..... 198/836.3 |
| 6,056,225 | A | * | 5/2000 | David et al. ..... 242/363 |
| 6,367,606 | B1 | * | 4/2002 | Skalla et al. ..... 193/6 |
| 6,402,074 | B1 | * | 6/2002 | Shore et al. ..... 242/363 |
| 7,806,356 | B2 | * | 10/2010 | Poloni et al. ..... 242/361.2 |
| 8,087,604 | B2 | * | 1/2012 | Palfreman et al. ..... 242/362.2 |

FOREIGN PATENT DOCUMENTS

| | | | |
|---|---|---|---|
| EP | 0920930 | A2 | 6/1999 |
| JP | 2001038418 | A | 2/2001 |
| KR | 20040020394 | A | 3/2004 |
| WO | 0145875 | A1 | 6/2001 |

OTHER PUBLICATIONS

PCT International Search Report mailed Jan. 8, 2013 corresponding to PCT International Application No. PCT/US2012/055710 filed Sep. 17, 2012 (12 pages).

* cited by examiner

*Primary Examiner* — Douglas Hess

(57) ABSTRACT

A laying head tripper has a ramp with a lip detachably secured to its forward edge. The ramp and/or the lip are contoured to match the curvature of the rings being formed by the laying head.

12 Claims, 3 Drawing Sheets

MODULAR TRIPPER FOR ROLLING MILL LAYING HEAD

CROSS REFERENCE TO RELATED APPLICATION

This application claims benefit, under 35 U.S.C. §119(e), of U.S. Provisional Application Ser. No. 61/539,076, filed 26 Sep. 2011, the entire contents and substance of which is hereby incorporated by reference.

BACKGROUND

1. Field

Embodiments of the present invention relate generally to rolling mill laying heads employed to form hot rolled products into helical ring formations, and are concerned in particular with an improved tripper for engaging and toppling the rings onto a conveyor for transport in an overlapping pattern to a remote location.

2. Description of Related Art

In a conventional laying head, as shown at 10 in FIG. 8, the rotating laying pipe 12 is surrounded by a cylindrical shroud 14. The laying pipe 12 forms the hot rolled product into a helical formation of rings "R". As the rings R exit the shroud 14, they engage a tripper plate 16, causing the rings to topple forwardly onto a roller conveyor 18 or other like means designed to transport the rings in an overlapping pattern to a remote location.

The tripper 16 is flat, with a welded straight lip 16*a* positioned to engage the exiting rings. Experience has shown that as rolling speeds increase, the rings R end up making only point contact with the tripper lip 16*a*, leading to erratic tripping and non uniform distribution of the rings R on the conveyor 18.

Also, the tripper lip 16*a* is prone to rapid wear, requiring frequent and costly replacement of the entire tripper.

SUMMARY

Broadly stated, embodiments of the present invention address the drawbacks of the prior art by providing an improved tripper with a plate and/or lip contoured to more reliably contact the rings, and with a modular construction allowing the lip to be readily replaced when worn, or when differently contoured shapes are required to handle the rings of different products.

In exemplary embodiments, the tripper comprises a ramp on which the rings exiting from the laying head are carried towards the conveyor. A lip projects upwardly from a front edge of the ramp. The lip is positioned to engage and topple the rings onto the conveyor. At least one of the ramp or the top edge of the lip is contoured to conform to the curvature of the rings.

In one exemplary embodiment of the present invention, the lip is replaceable and detachably connected to the ramp. In another exemplary embodiment of the present invention, the ramp has a top surface inclined upwardly towards the lip. The top surface may be contoured with a gradually widening and deepening depression leading to the lip.

Preferably, both the top surface of the ramp and the top edge of the lip are contoured to conform to the curvature of the rings.

These and other objects, features and advantages of the present invention will become more apparent upon reading the following detailed description in conjunction with the accompanying drawings.

DETAILED DESCRIPTION

Figure 1:
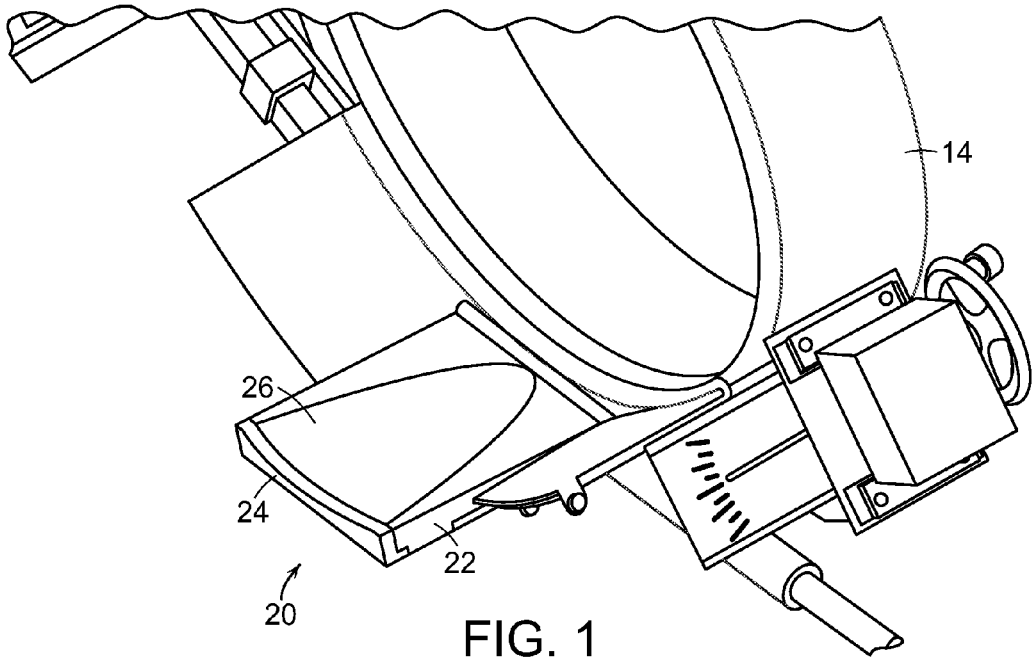
FIG. 1 is a partial perspective view of a laying head incorporating of a tripper, in accordance with an exemplary embodiment of the present invention.
Figure 2:
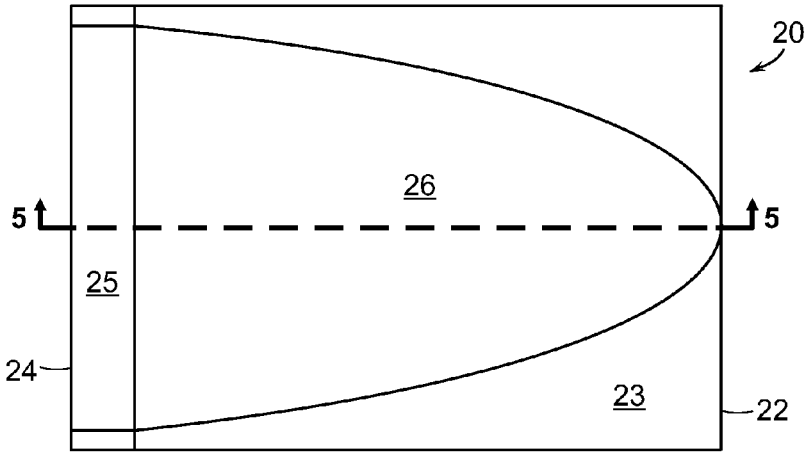
FIG. 2 is a top plan view of the tripper, in accordance with an exemplary embodiment of the present invention.
Figure 3:
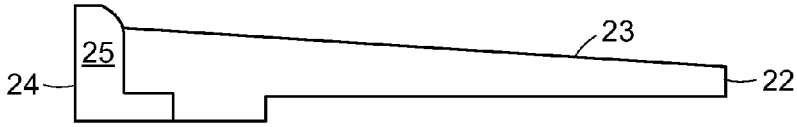
FIG. 3 is a side elevation view of the tripper, in accordance with an exemplary embodiment of the present invention.
Figure 4:
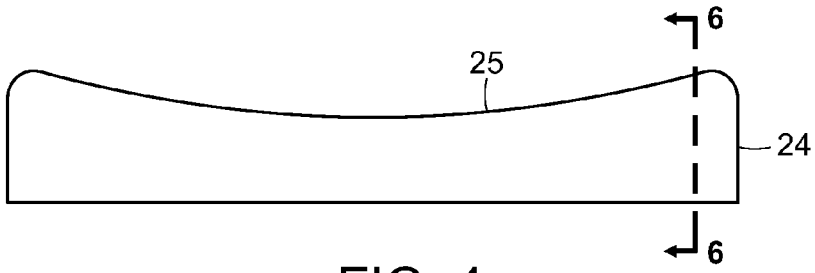
FIG. 4 is an end view of the tripper, in accordance with an exemplary embodiment of the present invention.
Figure 5:
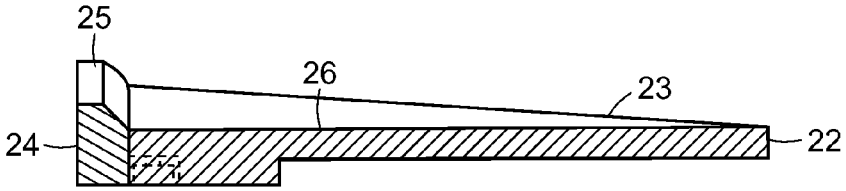
FIG. 5 is a sectional view taken along line 5-5 of FIG. 2, in accordance with an exemplary embodiment of the present invention.

The components described hereinafter as making up the various embodiments are intended to be illustrative and not restrictive. Many suitable components that would perform the same or a similar function as well as the materials described herein are intended to be embraced within the scope of embodiments of the present invention.

Referring now to the figures, wherein like reference numerals represent like parts throughout the views, embodiments of the present invention will be described in detail.

With reference to FIG. 1, a tripper 20 in accordance with an exemplary embodiment of the present invention is shown mounted at the exit end of a laying head shroud 14. The tripper includes a ramp 22 with a lip 24 projecting upwardly from its forward edge.

Figure 8:
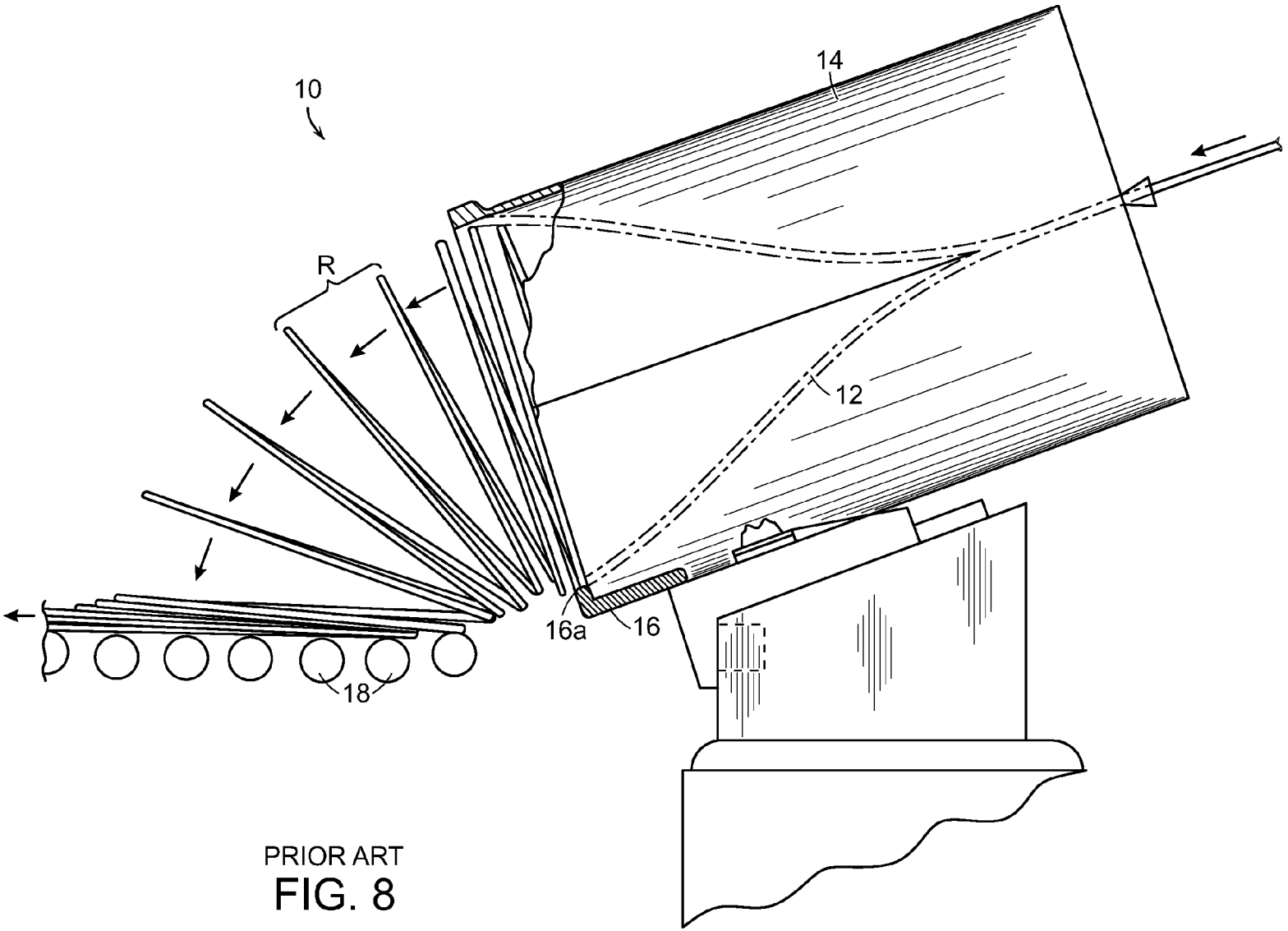
PRIOR ART FIG. 8
FIG. 8 is an illustration of a laying head employing a conventional tripper.

As with the conventional tripper shown in FIG. 8, the ramp 22 is positioned to carry rings exiting from a laying head towards a conveyor, and the lip 24 is positioned to engage and topple the rings onto the conveyor.

With reference additionally to FIGS. 2-5, it will be seen that the ramp 22 may have a top surface 23 inclined upwardly towards the tip 24.

At least one and preferably both the top surface 23 of the ramp 22 and a top edge 25 of the lip are contoured to conform to the curvature of the rings. Thus, the top surface 23 of the ramp may be provided with a gradually widening and deepening depression 26 leading to the lip 24, and the top edge 25 of the tip may have a complimentary concave curvature.

The contoured top surface 23 of the ramp 26 provides better support for the rings as they move into engagement with the lip 24. The curved top edge 25 of the lip creates larger surface contact with the rings, thereby improving tripping consistency and increased tip service life.

Figure 6:
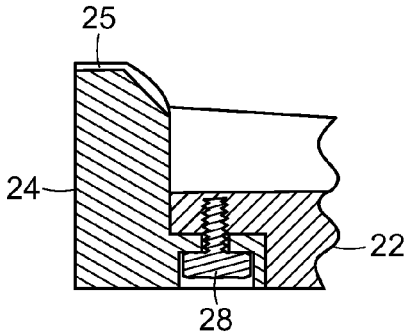
FIG. 6 is a sectional view on an enlarged scale, taken along line 6-6 of FIG. 4, in accordance with an exemplary embodiment of the present invention.
Figure 7:
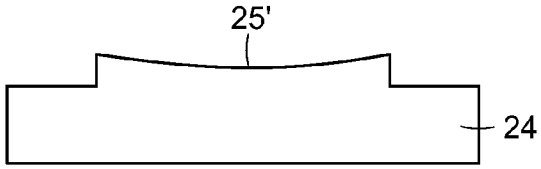
FIG. 7 is an end view of a tripper using a lip with an alternative configuration, in accordance with an exemplary embodiment of the present invention.

The lip 24 can be replaceable and detachably connected to the ramp 22. Thus, as shown for example in FIG. 6, the lip 24 may be attached to the ramp by bolts 28 or other equivalent fastening means. Multiple lip profiles can be used to optimize the tripping characteristics. A non-limiting example of one such profile is shown in FIG. 7, where the top edge 25 of the lip is only partially arcuate. The modular tripper components can be fabricated from various wear resistant materials (mild steel, tool steel, heat treated, etc) to best suit different products (carbon steel, stainless steel, etc).

While exemplary embodiments of the invention have been disclosed, modifications, additions and deletions can be made without departing from the spirit and scope of the invention and its equivalents, as set forth in the following claims.

What is claimed is:

1. A tripper for use in a rolling mill in which a laying head forms a hot rolled product into a continuous series of rings, and the rings exit from the laying head onto a conveyor for transport in an overlapping pattern, said tripper comprising:

a ramp on which the exiting rings are carried along a delivery path towards the conveyor; and a lip extending transversely with respect to said delivery path and projecting upwardly from a forward edge of said ramp, said lip being positioned to engage the bottoms of the rings and to thereby topple the rings onto the conveyor, at least one of said ramp or a top edge of said lip being contoured to conform to the curvature of the rings.

2. The tripper of claim 1, wherein said lip is replaceable and detachably connected to said ramp.

3. The tripper of claim 1, wherein a top surface of said ramp is contoured with a gradually widening and deepening depression leading to said lip.

4. The tripper of claim 3, wherein said top surface is inclined upwardly towards said lip.

5. A tripper for use in a rolling mill in which a laying head forms a hot rolled product into a continuous series of rings, and the rings exit along a delivery path from the laying head onto a conveyor for transport in an overlapping pattern, said tripper comprising:

a ramp underlying and on which the exiting rings are carried towards the conveyor; and an upwardly projecting lip extending across and detachably connected to a forward edge of said ramp, said lip being positioned to engage the bottoms of the rings and to thereby topple the rings onto the conveyor, said ramp and a top edge of said lip being contoured to conform to the curvature of the rings.

6. The tripper of claim 5, wherein said lip is replaceable and detachably connected to said ramp.

7. The tripper of claim 5, wherein a top surface of said ramp is inclined upwardly towards said lip and contoured with a gradually widening and deepening depression leading to said lip.

8. A tripper assembly comprising:

a ramp underlying and on which products are conveyed along a delivery path;

a lip extending transversely with respect to said delivery path and projecting upwardly from a forward edge of the ramp, the lip being positioned to trip the products, and at least one of the ramp or a top edge of said lip being contoured to conform to the shape of the products.

9. The tripper assembly of claim 8, the lip and the ramp being coupled to one another via a removable fastening device.

10. The tripper assembly of claim 8, the ramp having an upwardly inclined top surface.

11. The tripper assembly of claim 10, a top surface of said ramp being contoured with a gradually widening and deepening depression leading to said lip.

12. The tripper assembly of claim 8, a top surface of said ramp being contoured with a gradually widening and deepening depression leading to said lip.

* * * * *